US005232430A

United States Patent [19]

Nitsch

[11] Patent Number: 5,232,430

[45] Date of Patent: Aug. 3, 1993

[54] APPARATUS FOR PIERCING SLITS IN PLASTIC SHEET MATERIAL

[76] Inventor: J. Leonard Nitsch, 110 Hampshire Rd., Syracuse, N.Y. 13203

[21] Appl. No.: 918,606

[22] Filed: Jul. 27, 1992

[51] Int. Cl.[5] ..... B31B 1/14

[52] U.S. Cl. ..... 493/341; 493/194; 493/238; 493/372; 493/468; 83/620; 83/660; 83/695

[58] Field of Search ..... 30/355, 357, 358, 366; 83/660, 689, 695, 30, 18, 140, 678, 620; 493/194, 197, 198, 199, 203, 238, 233, 372, 468, 341

[56] References Cited

U.S. PATENT DOCUMENTS 3,795,163 3/1974 Armstrong ..... 83/660
3,824,887 7/1974 Marchard .
3,841,189 10/1974 Spengler .
3,866,491 2/1975 Marchard .
4,132,138 1/1979 Miyamoto .
4,176,567 12/1979 Weisberg .
4,358,979 11/1982 Kurzbuch ..... 83/660
4,768,411 9/1988 Su .
4,852,442 8/1989 Pottorff .
5,001,956 3/1991 Nitsch .
5,064,408 11/1991 Bridgeman ..... 493/194

*Primary Examiner*—Bruce M. Kisliuk
*Assistant Examiner*—Jack Lavinder
*Attorney, Agent, or Firm*—Wall and Roehrig

[57] ABSTRACT

A piercing blade for perforating slits in a continuous tubular web of thermo-plastic material is shown. The blade is used in a machine to form individual bags from the tube by heat sealing the bottom and perforating the top of the next bag. The piercing teeth in the blade have formed in the front face a number of horizontal grooves which serve to pick up the edge of the top layer of the slit to form a burr thereon and thus separate the two plys of the tubular web, facilitating the opening of the top of the bag when it is separated from the roll of continuous tubular material.

7 Claims, 1 Drawing Sheet

APPARATUS FOR PIERCING SLITS IN PLASTIC SHEET MATERIAL

BACKGROUND OF THE INVENTION

This invention relates to apparatus for piercing slits in plastic films and more particularly to an apparatus and blade for piercing a series of slits across the width of a tube of thermo-plastic film material for the manufacture of rolls of continuous but separable plastic bags.

In the manufacture of bottom sealed thermo-plastic bags, it is necessary to process a tube of material through an apparatus which produces a heat seal across the width of the tube and an adjacent series of slits. The heat seal provides the bottom closure for one bag and the series of slits form a parting line for separating the one bag from the other and forming a top opening for the next bag when the bags are separated by tearing along the line of the slits. As is well known in the industry, the perforated tubular web or film, as it is commonly referred to, must have sufficient strength in the remaining areas between the sheets to maintain integrity of the roll until it is desired to separate the bags.

A common technique for heat sealing and perforating a tubular film to form bags is to index the film as it emerges from the blown film extrusion through an in-line bag machine such as commercially available from the Gloucester Universal Bag Machine, marketed by Gloucester Engineering Company, located in Gloucester, Mass. In a machine of this type, a reciprocating serrated blade and sealing element are reciprocated into and out of contact with the tubular film to heat seal the film to form the bottom of one bag while piercing a series of slits across the width of the film adjacent the heat sealed bottom to form the top opening of the next bag when separated from the tubular film. This in-line bag machine functions satisfactorily for many types of films such as low density polyethylene (LDPe) film. However, it has been found that machines of this type are not entirely satisfactory for linear low density polyethylene (LLDPe) in that the blade must be carefully maintained to provide satisfactory penetration, and even the slightest dulling tends to push the film downwardly into the slot underlying the film, resulting in partial perforations, or if the film is fully supported in the underlying slot, it tends to weld together the edges of the slit formed by the blade penetration. Furthermore, the downward pushing action, particularly of a dull blade, increases the film tension in the heat sealing region and adversely effects the quality of the closure attained.

In U.S. Pat. No. 5,001,956, issued Mar. 26, 1991, I have disclosed a blade for use in a piercing or slitting operation which provides an improved slitting action to form arcuate slits across the width of the tubular thermo-plastic film which eases the piercing force required, and which prevents the sealing together of the edges of the slits across the tubular web so that when the bag is separated from the continuous web, the top can be readily opened.

OBJECTS AND SUMMARY OF THE INVENTION

The present invention is an improved blade for piercing tubular plastic film webs used to manufacture plastic bags that pierces the tear slits so as to preopen the tubular web of thermo-plastic material at the top of the bag when it is separated from the continuous film of formed bags. The present invention is an improvement over the aforesaid patent and assists in the separating action of the two plys of the tubular film at the edges of the slits, both upon insertion of the piercing knife through the tubular plastic web and especially upon withdrawal of the piercing blade to the retracted position.

It is accordingly an object of the present invention to provide an improved piercing blade for forming a series of semi-arcuate slits across a tubular web of plastic material.

It is another object of the present invention to provide an improved apparatus for forming tear perforations across the width of a tubular film in which the slit edge along the row of perforations is preopened for the user when the individual bag is separated from the continuous roll.

According to the present invention, applicant has provided a series of grooves on the front face of the perforating teeth of the blade which grooves are generally perpendicular to the direction of motion of the blade during the piercing operation. In the normal machine such as referred to above where the blade is generally an elongated horizontal blade, the grooves are generally formed in a horizontal line across the front face of the teeth from one end to the other of the blade. The grooves of the present invention have been found to improve the separation of the two plys of the tubular web as it is passed through the bag forming machine and prevents the apparent sealing together of the top edge of a bag after it is formed and separated from the continuous web. Not only is the bag effectively pre-opened, but a roughened surface or tab is provided that can be readily manipulated between the fingers of the user to quickly open and separate the top layers of the tubular web so as to gain access to the interior of the plastic bag.

These and other and further objects of the present invention, together with additional features and advantages accruing therefrom will be apparent from the following description of a preferred embodiment of the invention shown in the accompanying drawings, wherein:

DETAILED DESCRIPTION OF A PREFERRED EMBODIMENT

Figure 1:
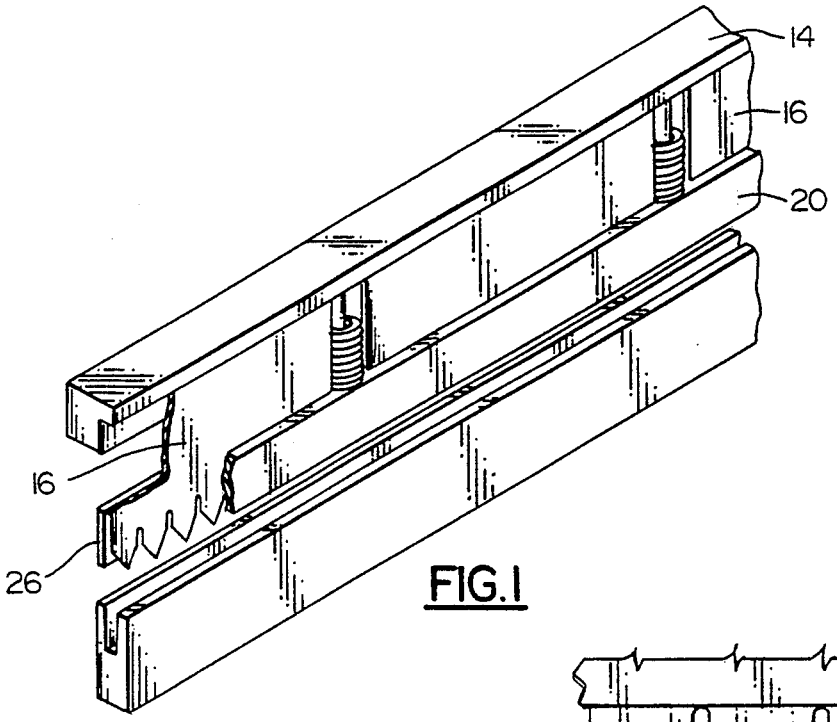
FIG. 1 is a perspective view of a typical device for perforating tubular plastic film in accordance with the present invention.

The drawing of FIG. 1 illustrates generally an apparatus for punching or piercing a line or series of slits across a double web of plastic film 10 which form e.g. a series of polyethylene film bags. The film is perforated to one side of a heat sealed seam and then is wound onto a drum or mandrel from which it is removed in the known fashion by the ultimate user as by tearing along the line of slits.

The film 10 is drawn between a backing die 12 and a punching head 14 which carries the slitting blade 16 which is reciprocated into the plastic film 10 at spaced intervals along with a heating die to heat seal across the film 10 at the same time that a line of slits are formed in the tubular film 10. Suitable hold down bars 20 are provided on either side of the slitting blade 16 to secure the plastic film 10 during the penetration cycle. This general configuration is well known in the prior art and shown in Kurzbach, U.S. Pat. No. 4,358,979.

Figure 3:
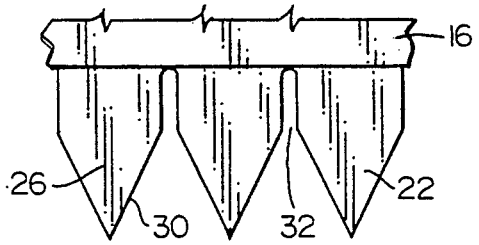
FIG. 3 is a view similar to FIG. 2 taken from the other side of the blade.
Figure 4:
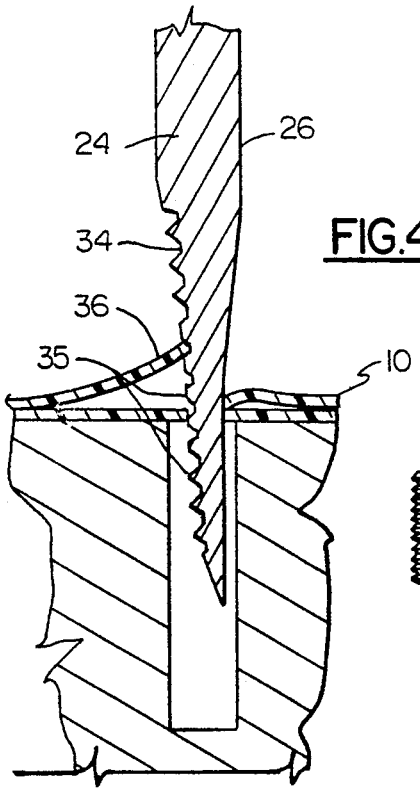
FIG. 4 is a side view in cross section showing the piercing blade of the present invention partially withdrawn from the web of plastic material.
Figure 2:
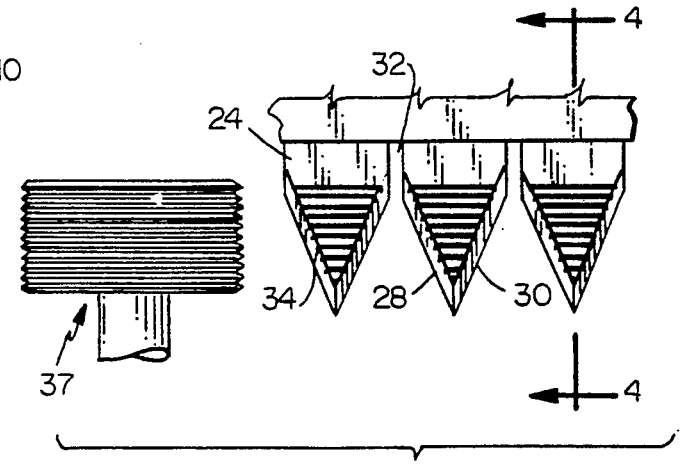
FIG. 2 is an enlarged fragmentary plan view of the teeth of the blade of FIG. 1 taken from one side with a grinding wheel for forming the grooves.

Suitable pneumatic cylinders, hydraulic cylinders, or mechanical linkages, not shown, are used to actuate the sealing and punching head to cause the blade 16 to pierce the web 10 to form spaced apart slits across the width thereof. Referring now to FIGS. 2–4, the slitting blade 16 is generally formed as shown and described in my prior U.S. Pat. No. 5,001,956, which is incorporated herein by reference for details. The teeth are formed as described and shown in the prior patent and are hollow ground as was taught therein. This shape and configuration can be seen in FIGS. 2–4 and the hollow-grind effect is perhaps best shown in the FIG. 4, cross section. In forming this hollow-ground surface, on either side of the tooth, the grinding was done in an average plane of approximately three degrees from the vertical of FIG. 4. It has caused the tooth to be tapered from the root section in FIGS. 2–4 down to the tip which was further sharpened on the front face so as to form the point for piercing the plastic film 10.

The teeth 22 have a front face 24 and a back surface 26. The front surface is bevel sharpened at 28 to form a cutting edge 30 in the back surface 26 of each tooth. The teeth in one configuration are separated by intervals 32 so that sufficient plastic film is retained in the tubular web as it is rolled up after processing to provide the necessary physical connection between bags. This unslit web portion 32 provides sufficient continuing strength to allow the rerolling of the tubular film into a form for use by the ultimate customer. The intervals 32 separating the teeth 30 may be omitted in certain embodiments of the invention where it is desirable to form a continuous slit across the entire width of the web or film.

As set forth in my prior patent, this configuration of teeth on a slitting blade has provided significant advantages over prior art slitting blades by reducing the pressure required to pierce the tubular web and by providing a differential buckling of the upper layer of plastic relative to the lower to effectively preseparate the upper and lower layers of plastic, at least on the side that is to form the top of an opening of a bag when torn from the roll. This action has been accomplished by the hollow ground feature of the teeth and greatly facilitates the opening of the separated bag when the bag is to be filled by the ultimate user. It has been found that under certain conditions and with certain materials, this action can be further enhanced by cutting a series of horizontal grooves 34 in the front face of the teeth of a blade 16 according to the present invention. The grooves 34 are formed in the front face of the teeth 22 by a contoured grinding wheel 37 that is passed longitudinally over the teeth as shown in FIG. 2. The grooves are formed on a plane that is angled from the plane of the blade at the same three degree angle as the hollow grinding plane described in my aforesaid patent, the teaching of which are herein incorporated by reference. By matching the plane of the forming of the grooves with the average plane of hollow grinding effect, the grooves take the form as shown in FIG. 4. Due to the combined action of the grooving wheel and the hollow grinding wheel, the regions or lands 35–35 between the grooves take on differing configurations, depending on the position of the groove on the tooth face. The lands situated at the upper and lower sections of each tooth have a relatively cross-sectional profile while those in the tooth midregion have a flatter configuration.

In operation, the blade with the teeth according to the present invention is penetrated into the tubular film 10 causing the film layers to vibrate. The front face 24 which has the grooves 34 thereon, provides a vibrating movement to the edge 36 of the upper layer of the web 10 and helps to fan the layers and thus produce separation of the layers. Upon withdrawal of the tooth 22 from the pierced web 10, the sharp edges of the grooves 34 and the spaced flat sections cooperate together to lift and pick up the upper layer 36 along the slit edge to form a burr on the surface adjacent the slits. This may be seen in detail in FIG. 4 in which the tooth 22 is being withdrawn from the piercing of the film 10 and it can be seen that the edge 36 of the upper layer is significantly extended and pulled up and retracted from the slit edge of the lower layer. This can be compared with the movement shown on the back side of the tooth where the upper edge is partially separated, but the action is not as complete or as extreme.

In operation, the front of the tooth 24 is faced toward the portion of the tubular film 10 that will form the top of the semi-completed bag so that when it is separated from the roll along the series of arcuate slits, the open end can be simply and easily opened. It is a common experience in the industry that once the bag is separated from the web in the traditional perforated roll, it is very difficult for the average user to open the bag. This is due not only to the sealing action of the penetration of the blade, but to the natural surface attraction due to static electricity and surface adhesion of plastic surfaces, one to the other. With the present invention, the upper edge of the slit is clearly separated from the lower edge to "preopen" the upper layer from the lower layer so that the bag, when it is torn from the continuous roll, is partially open and can be readily fully opened to receive therein the articles that it is desired to put in the bag.

In addition, the "burr" caused by the raising of the top layer due to the action of the grooves in the front face of the teeth 22 provides a line of greater frictional contact for the fingers of the user, as the user attempts to open the upper end of the torn-off sleeve, and further facilitates the manipulation of the user's fingers in the opening of the top of the bag for use. The burring and separating action of the grooves 34 is over and above the separation of the plys caused by the hollow grinding of the teeth.

In operation of the perforating apparatus as disclosed herein, it has been found that the horizontal grooves, in addition to raising a burr on one side of the slits, actually set up a vibration or a rhythmical flexing of the edge of the slits as the slitting blade 16 is penetrated in and out of the tubular plastic film. This physically shakes the two plys apart along the slit, leaving a slightly separated pair of plys in the tube. Upon tearing of one bag from the continuous tubular film roll, the perforated edge is already partially opened so that the user can easily grip the slit edge of the tube and with the additional friction provided by the burr and the sinuses edge at each arcuate slit, readily separate the two-plys so as to open the bag for insertion of the product to be placed therein. It is believed this vibrating action greatly enhances and expands the effect of the hollow grinding of the teeth as shown in my prior patent and facilitates the opening of the bag by the end user.

It will thus be seen that I have provided a superior blade for forming individual bags from a continuous tubular film or roll of polyethylene thermoplastic film by piercing a series of arcuate-shaped slits across the width thereof, which slits pre-open the top end of a bag formed therein so that upon separation from the continuous web the bag can be easily opened by the user to place the desired articles therein.

While this invention has been explained with reference to the structure disclosed herein, it is not confined to the details set forth and this application is intended to cover any modifications and changes as may come within the scope of the following claims:

What is claimed is:

1. An elongated perforating blade for use in apparatus for piercing a series of slits across the width of a two ply continuous plastic material film having a flat surface to form tear perforations for separating individual portions therefrom, the blade having a longitudinal axis being parallel to the surface of the film and being moved in a direction of penetration through a plane that is perpendicular to the film surface, the blade also having a plurality of aligned and tapered piercing teeth formed along a bottom edge thereof, said teeth having front and back surfaces and bevelled edges along the periphery of the front surface forming cutting edges with the back surface; the improvement comprising:

means forming an irregular surface on one face of said piercing teeth to catch and lift the top ply of the film along the edge of the slit and separate it from the bottom ply upon withdrawal of the perforating blade from the plastic material.

2. A blade according to claim 1 wherein said means of forming an irregular surface comprise a plurality of grooves formed in the front faces of said plurality of piercing teeth;

said grooves being oriented generally at right angles to the direction of penetration of the blade into a plastic film when in use.

3. A blade according to claim 1 wherein said means forming an irregular surface comprises a plurality of spaced apart ridges formed in one side surface of said plurality of piercing teeth substantially parallel to the longitudinal axis of the perforating blade, so that upon withdrawal of said perforating blade from a two ply plastic material, said ridges will catch and lift up the top ply of plastic along each slit edge to pre-open a bag formed from an individual portion separated from said continuous film.

4. A blade according to claim 1 wherein said front and back surfaces of each tooth are hollow ground so that the thickness of the tooth decreases from the root to the tip of the tooth;

said means forming an irregular surface on one face of said piercing teeth comprises a plurality of grooves formed in the front faces of said teeth; and said grooves being formed in the hollow ground front face of said teeth generally parallel to the longitudinal axis of the perforating blade.

5. A blade according to claim 4 wherein said front and back surfaces of each tooth are hollow ground in an average plane displaced from the plane of movement of said blade by an acute angle; and said grooves are flat ground in a plane congruent with the average plane of the hollow grinding so that the depth of said grooves is greatest adjacent the tip and root of said teeth and smallest at the middle of said hollow ground teeth.

6. The method of forming pre-tear perforated bag segments in a continuous two-ply film of plastic material for separation into individual bags sealed at one end and open at the other, which includes the steps of:

piercing a series of short spaced apart slits across the width of the plastic material to form an openable top end of a first bag when separated from the continuous two-ply film;

substantially simultaneously thereto, sealing together the two-ply film across the width thereof adjacent one side of the spaced apart slits to form a closed bottom end of a second bag;

vibrating the slit edges of at least one side of the slits to separate the two plies of the plastic material from each other during and after piercing;

causing the edge of each slit in the upper ply of the plastic material to raise away from the edge of each corresponding slit in the lower ply; and forming a burr proximate to the raised edge of each slit in the upper ply so that when a bag segment is separated from the continuous film, the plies thereof are partially pre-opened to facilitate further opening of the individual bag.

7. An apparatus for forming individual bags from a continuous flattened tubular web of plastic which comprises a punching head mounted generally perpendicular to the plane of the web and reciprocated to pierce a series of slits in said web;

a heat sealing platen extending across said web and reciprocated with said punching head to seal said web together adjacent to said series of slits, forming the bottom of a bag and a partially severed top of the next bag;

an elongated perforating blade fixed in said punching head for piercing said series of slits across said web;

said blade having a plurality of aligned and tapered teeth formed along a bottom edge of the blade and having a front surface and a back surface, said back surface being adjacent said sealing platen;

said front surface having bevelled edges forming a cutting edge in the back surface;

a plurality of grooves formed in the front faces of said plurality of teeth; and said grooves being formed generally parallel to the length of said perforating blade.

* * * * *